US009032658B2

(12) United States Patent
Geissele

(10) Patent No.: US 9,032,658 B2
(45) **Date of Patent: *May 19, 2015**

(54) MODULAR RIFLE HANDGUARD

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/148,363

(22) Filed: Jan. 6, 2014

(65) Prior Publication Data

US 2014/0144059 A1 May 29, 2014

Related U.S. Application Data

(63) Continuation of application No. 13/674,401, filed on Nov. 12, 2012, now Pat. No. 8,819,980.

(51) Int. Cl.
*F41C 23/00* (2006.01)
*F41C 23/16* (2006.01)

(52) U.S. Cl.
CPC ..... *F41C 23/16* (2013.01); *Y10T 29/49948* (2015.01); *Y10T 29/49778* (2015.01)

(58) Field of Classification Search
USPC ..... 42/71.01, 75.01, 90, 124, 127
See application file for complete search history.

(56) References Cited

U.S. PATENT DOCUMENTS

| | | | |
|---|---|---|---|
| 6,449,893 | B2 | 9/2002 | Spinner |
| 6,792,711 | B2 | 9/2004 | Battaglia |
| 6,836,990 | B2 | 1/2005 | Shiloni |
| 6,854,206 | B2 | 2/2005 | Oz |
| RE39,465 | E | 1/2007 | Swan |
| 7,191,557 | B2 | 3/2007 | Gablowski et al. |
| 7,216,451 | B1 | 5/2007 | Troy |
| 7,231,861 | B1 | 6/2007 | Gauny et al. |
| 7,313,883 | B2 | 1/2008 | Leitner-Wise |
| RE40,216 | E | 4/2008 | Swan |
| 7,430,828 | B2 | 10/2008 | Munst |
| 7,523,580 | B1 | 4/2009 | Tankersley |
| 7,685,759 | B2 | 3/2010 | Teetzel |
| 7,716,865 | B2 | 5/2010 | Daniel et al. |
| 7,770,317 | B1 | 8/2010 | Tankersley |
| 7,793,452 | B1 | 9/2010 | Samson et al. |
| 7,802,392 | B2 | 9/2010 | Peterson et al. |
| 7,823,316 | B2 | 11/2010 | Storch et al. |
| D641,450 | S | 7/2011 | Ding |
| 2006/0053673 | A1 | 3/2006 | Murello |

(Continued)

OTHER PUBLICATIONS

Rail photo, Troy Industries, Inc., 08-42-51-718, 1 page (Oct. 9, 2012).

(Continued)

*Primary Examiner* — Michael David
(74) *Attorney, Agent, or Firm* — Merchant & Gould, P.C.

(57) ABSTRACT

The present disclosure provides an ergonomic handguard that supports rail mounted weapon accessories in a variety of different orientations. The handguard includes sides and bottom surfaces that are ergonomic. The stem includes modular sections of picatinny rail that can be attached to various locations on the handguard as needed to provide a mounting structure for rail based weapon accessories.

7 Claims, 24 Drawing Sheets

(56) References Cited

U.S. PATENT DOCUMENTS

| | | | |
|---|---|---|---|
| 2008/0092422 | A1 | 4/2008 | Daniel et al. |
| 2008/0168696 | A1 | 7/2008 | Orne et al. |
| 2008/0178511 | A1 | 7/2008 | Storch et al. |
| 2008/0216380 | A1 | 9/2008 | Teetzel |
| 2009/0288324 | A1 | 11/2009 | Peterson et al. |
| 2010/0005697 | A1 | 1/2010 | Fluhr et al. |
| 2010/0126054 | A1 | 5/2010 | Daniel et al. |

OTHER PUBLICATIONS

Rail 1 photo, Knight's Armament Co., 1 page (date unknown).
Rail 2 photo, Knight's Armament Co., 1 page (date unknown).

MODULAR RIFLE HANDGUARD

TECHNICAL FIELD

The present disclosure provides an ergonomic handguard for a rifle configured to support modular accessories rails.

BACKGROUND

Handguards are designed to protect the shooter from being burned due to contact with the hot barrel of a firearm. Commonly handguards also designed to facilitate the connection of weapon accessories (optics, laser, night vision, foregrips, bipods, tactical lights, etc.) to the firearm.

Handguards having four picatinny rails located around the barrel (a top rail, a bottom rail, a left rail, and a right rail) are known. Typically, each of the four rails run the length of the handguard which allows rail mounted weapon accessories to be located on many different positions on the handguard. These rails system (quad rail systems) are generally not comfortable to hold as the rails themselves are not ergonomic. The present disclosure provides a handguard with improved functionality and ergonomics.

SUMMARY

The present disclosure provides an ergonomic handguard that supports rail mounted weapon accessories in a variety of different orientations. The handguard includes sides and bottom surfaces that are ergonomic. The stem includes modular sections of picatinny rail (M1913 mounting rail) that can be attached to various locations on the handguard as needed to provide a mounting structure for rail based weapon accessories.

BRIEF DESCRIPTIONS OF THE FIGURES

DETAILED DESCRIPTION

The present disclosure provides an ergonomic handguard that is configured to support rail mounted weapon accessories (optics, laser, night vision, foregrips, bipods, tactical lights, etc.).

In the depicted embodiments the handguard has a unitary construction. Its body portion is constructed from an extruded aluminum that is subsequently machined. The handguard is of the free floating type. In other words, forces applied to the handguard via the shooter's hand or a biped are not transmitted to the barrel. This free floating construction allows for more accurate shooting and is described in greater detail below. It should be appreciated that many other alternative configurations are also possible (e.g., multiple piece construction, non-free floating constructions, no metal constructions, etc,).

Figure 9:
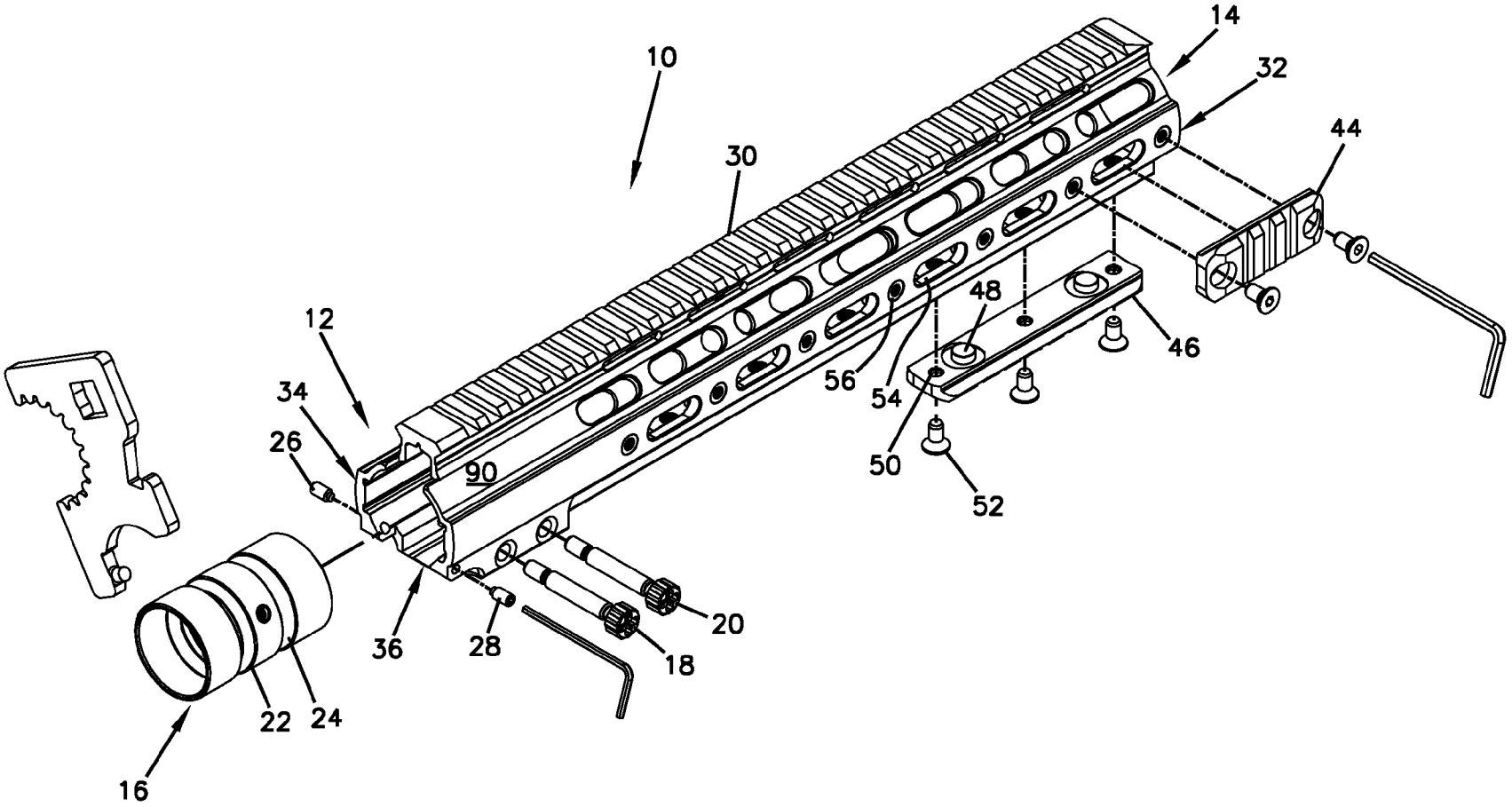
FIG. 9 is an assembly view of the handguard of FIG. 1.
Figure 10:
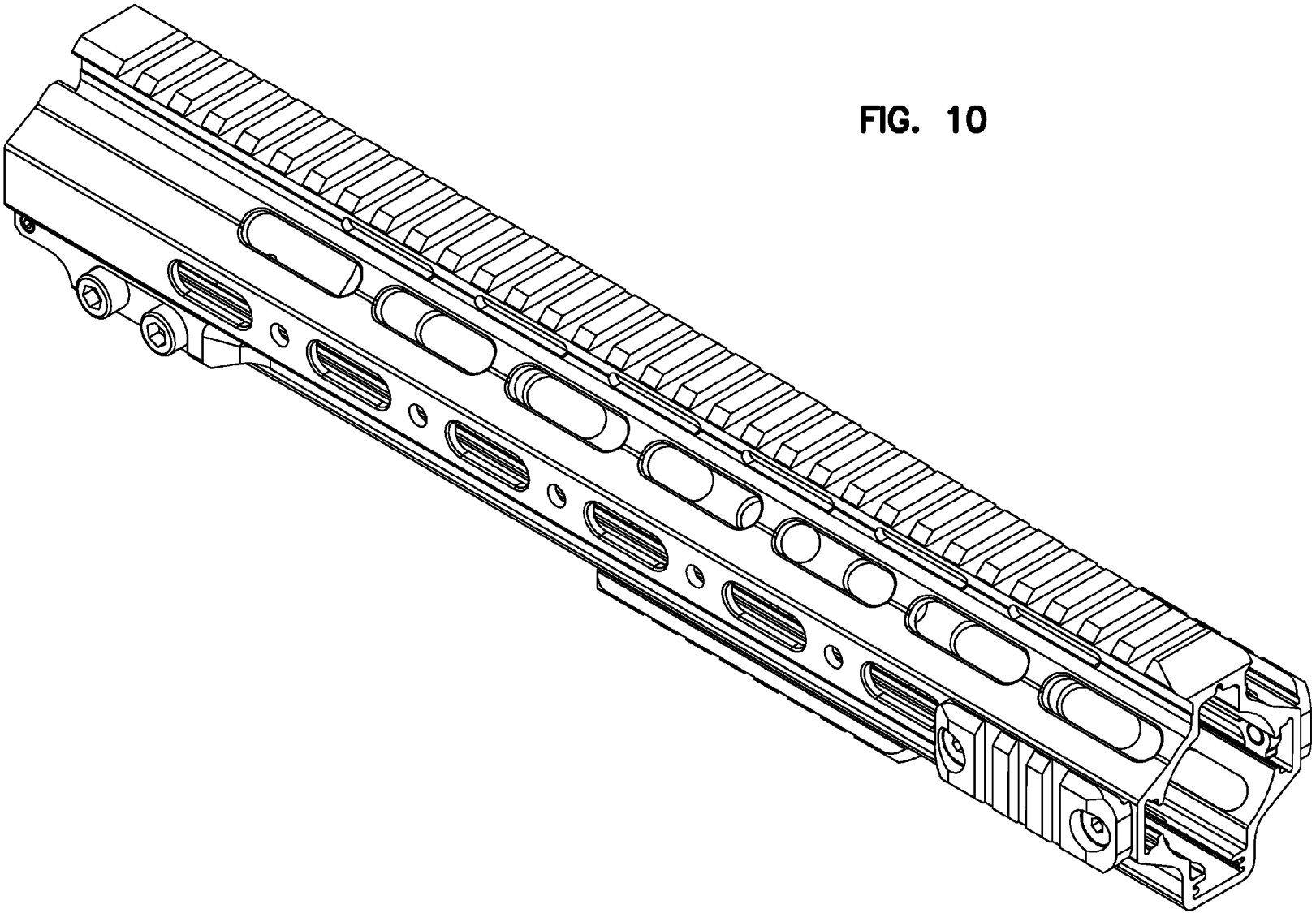
FIG. 10 is a front right isometric view of the handguard according to a second embodiment of the present disclosure.
Figure 11:
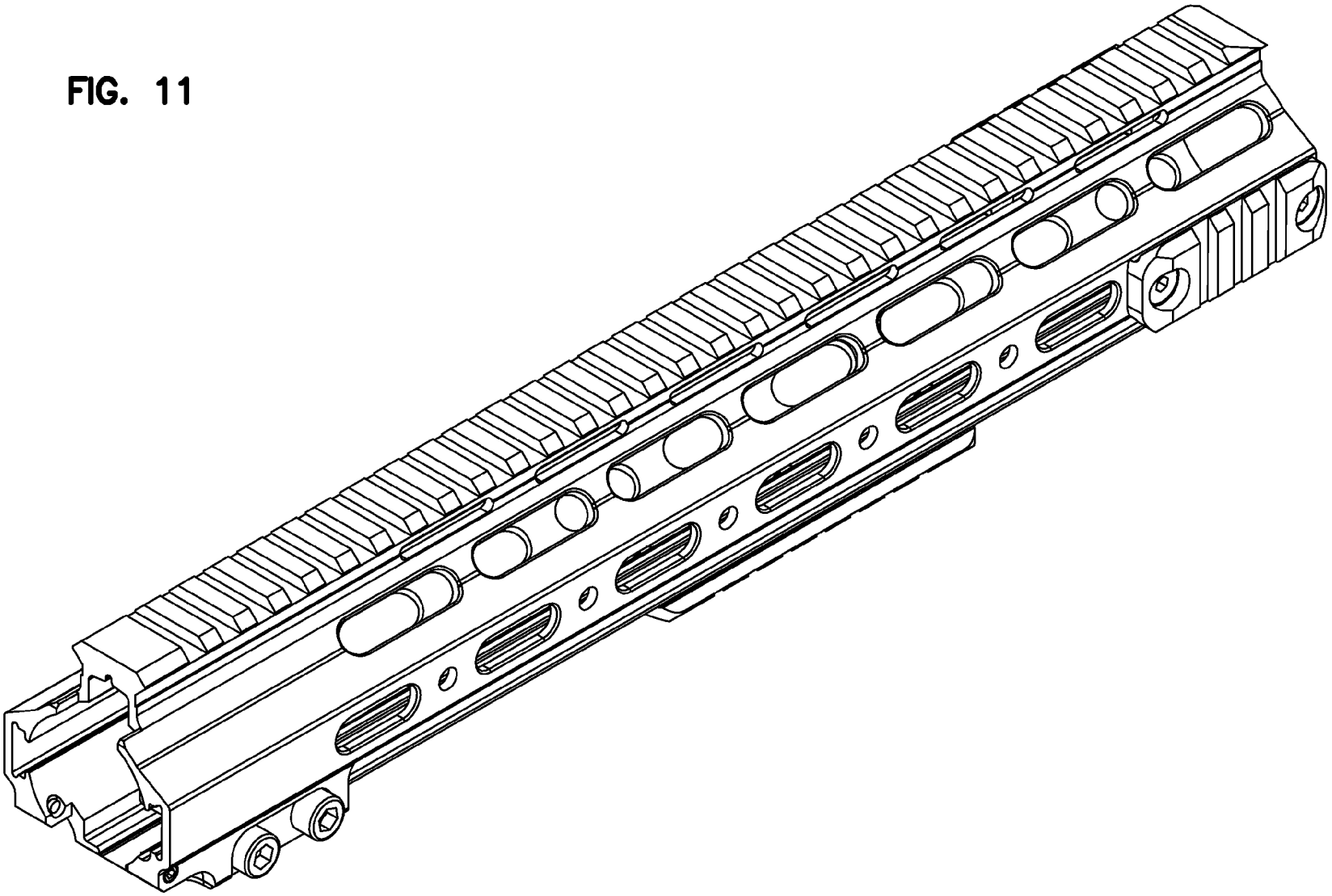
FIG. 11 is a rear left isometric view of the handguard of FIG. 10.
Figure 13:
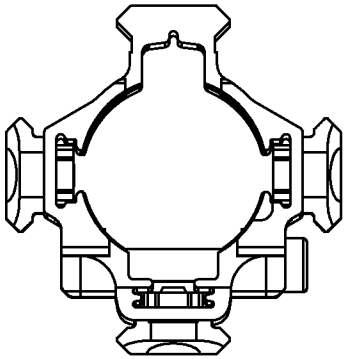
FIG. 13 is a rear elevation view of the handguard of FIG. 10.
Figure 12:
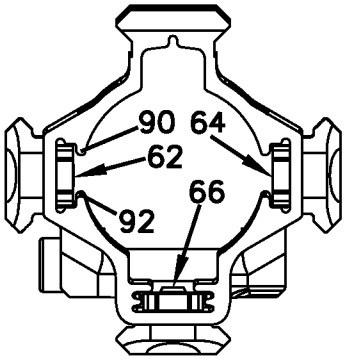
FIG. 12 is a front elevation view of the handguard of FIG. 10.
Figure 14:
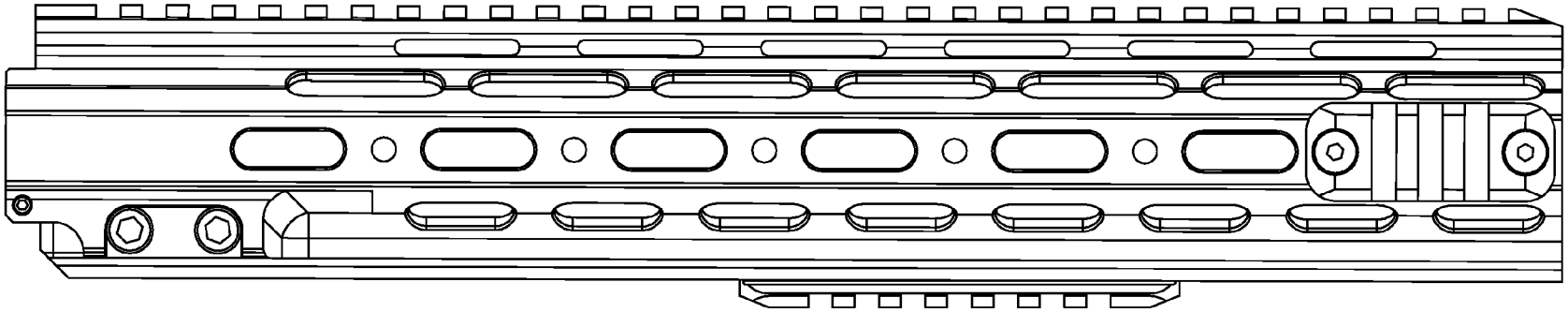
FIG. 14 is a left side elevation view of the handguard of FIG. 10.
Figure 15:
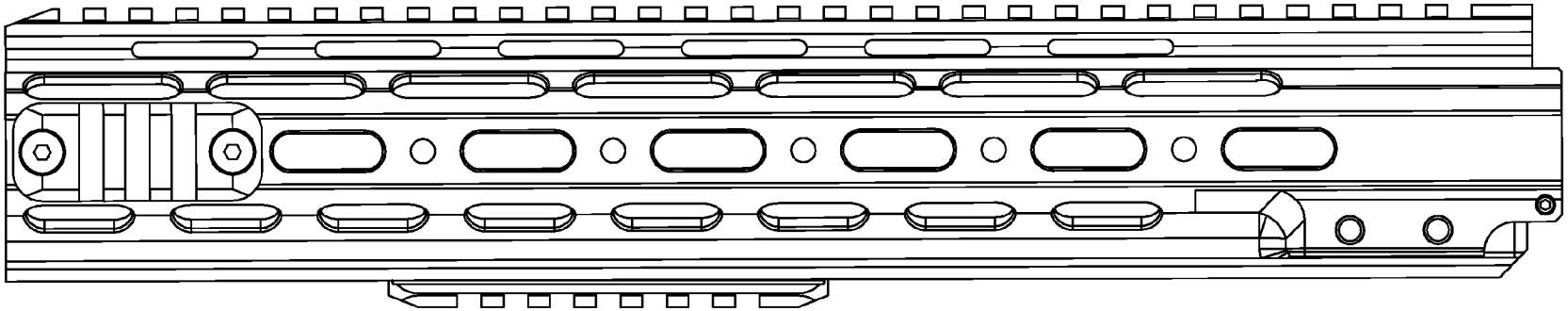
FIG. 15 is a right side elevation view of the handguard of FIG. 10.
Figure 16:
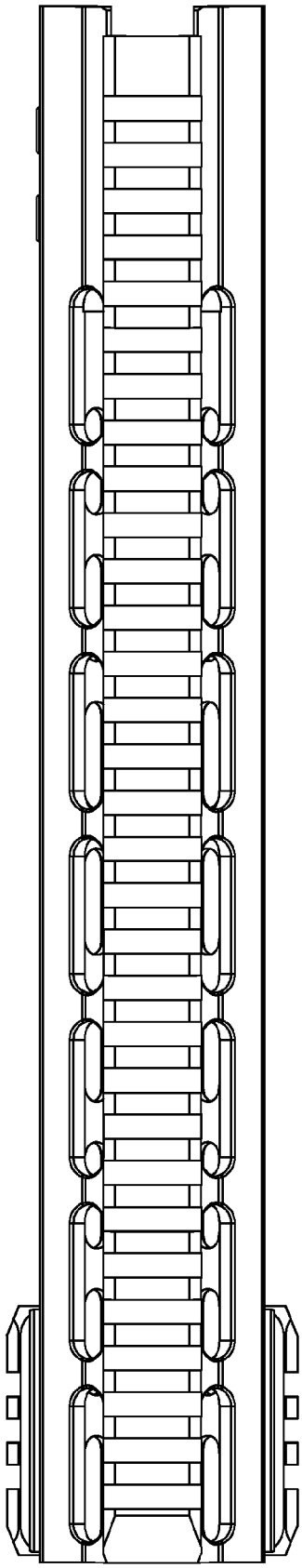
FIG. 16 is a top view of the handguard of FIG. 10.
Figure 17:
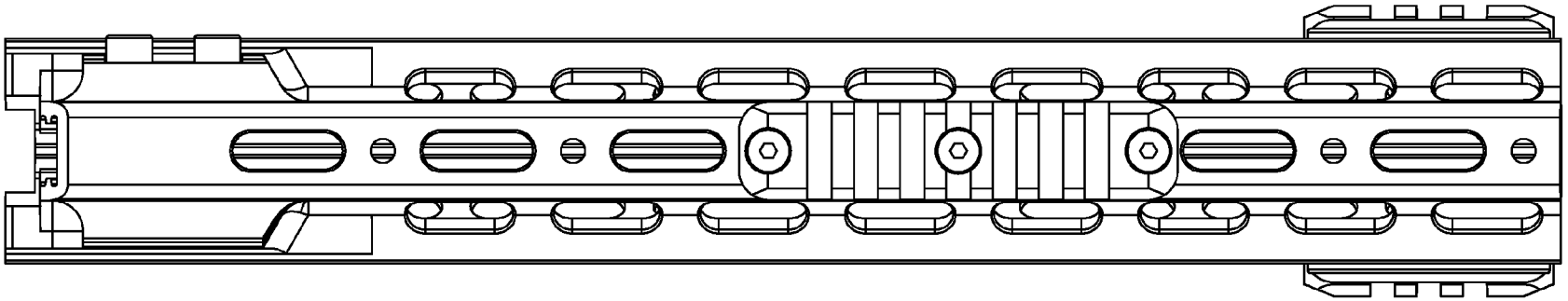
FIG. 17 is a bottom view of the handguard of FIG. 10.

Referring to FIGS. 1-9, the handguard 10 in the depicted embodiment includes a first end portion 12 that is configured to mount adjacent to a receiver of a rifle, and an opposed second end portion 14 located at the barrel end of the rifle (see FIG. 9). The first end portion is mounted to a barrel nut 16, which is threaded to the exterior of the barrel. The inside surface of the first end portion 12 of the handguard is configured to clamp onto the barrel nut when threaded bolts 18, 20 are tightened. In the depicted embodiment, the threaded bolts 18, 20 pass through groves 22, 24 on the barrel nut that prevent the handguard from moving axially relative to the barrel nut 16. The remaining body portion of the handguard 10 is cantilevered off the barrel nut 16. In the depicted embodiment, a pair of set screws 26, 28 are provided to ensure that the handguard does not rotate about the barrel nut 16. In the depicted embodiment, the barrel nut 16 is elongated (e.g., greater than 1 inch) to account for the cantilever load applied thereto given the free floated construction of the handguard (i.e., the handguard of the depicted embodiment is not supported by the barrel of the rifle at the second end 14). Is should be appreciated that many other alternative configurations are also possible.

In the depicted embodiment, the handguard 10 includes an integral upper rail 30 (see FIG. 9). In the depicted embodiment, the upper rail 30 runs the length of the handguard and is configured to be aligned with the top of the receiver, which may also include a rail. The upper rail 30 can be used to support a rail mountable weapon accessory. Typically, the upper rail is used to mount optics (e.g., scopes and sights).

Figure 1:
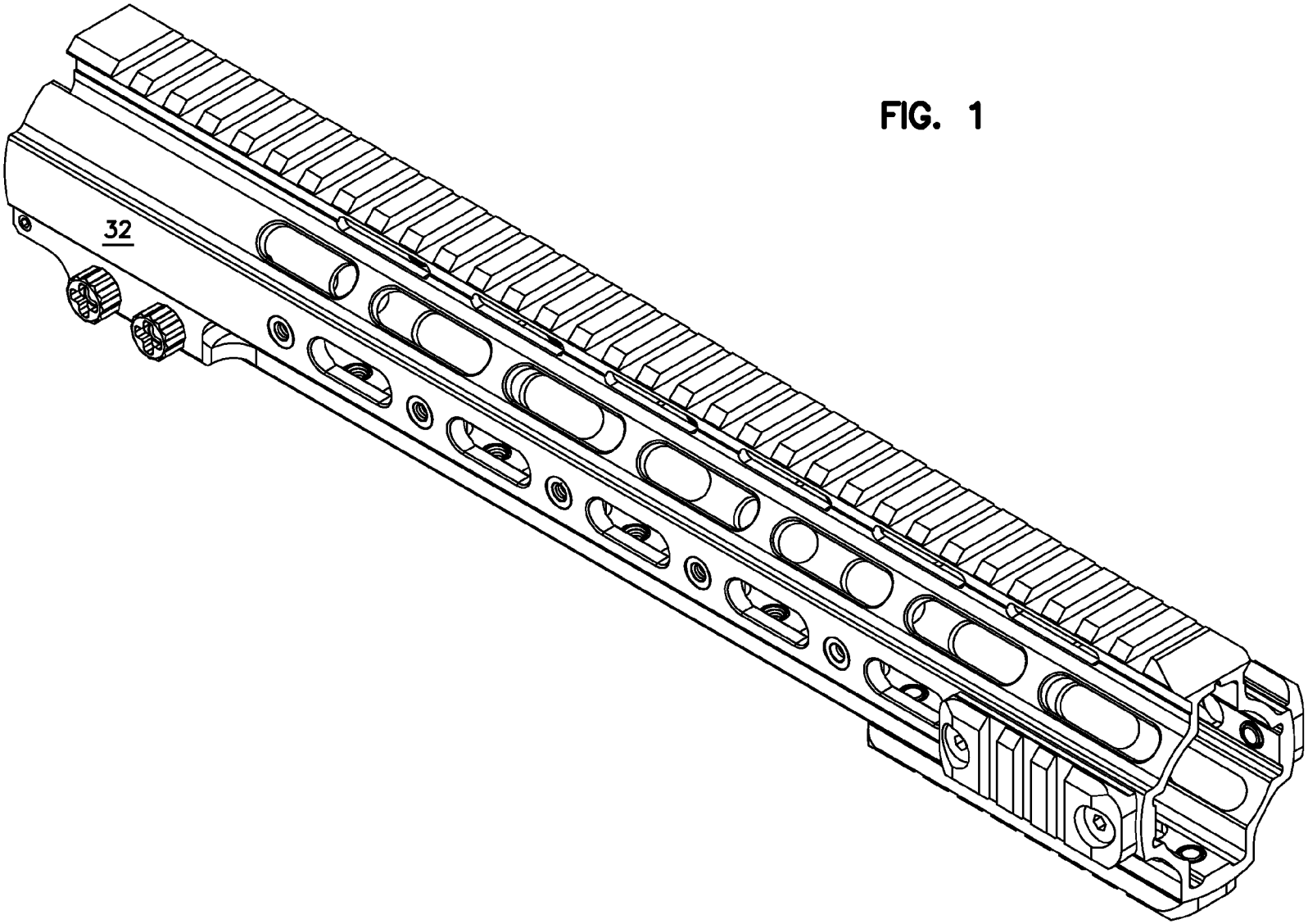
FIG. 1 is a front right isometric view of the handguard according to a first embodiment of the present disclosure.
Figure 2:
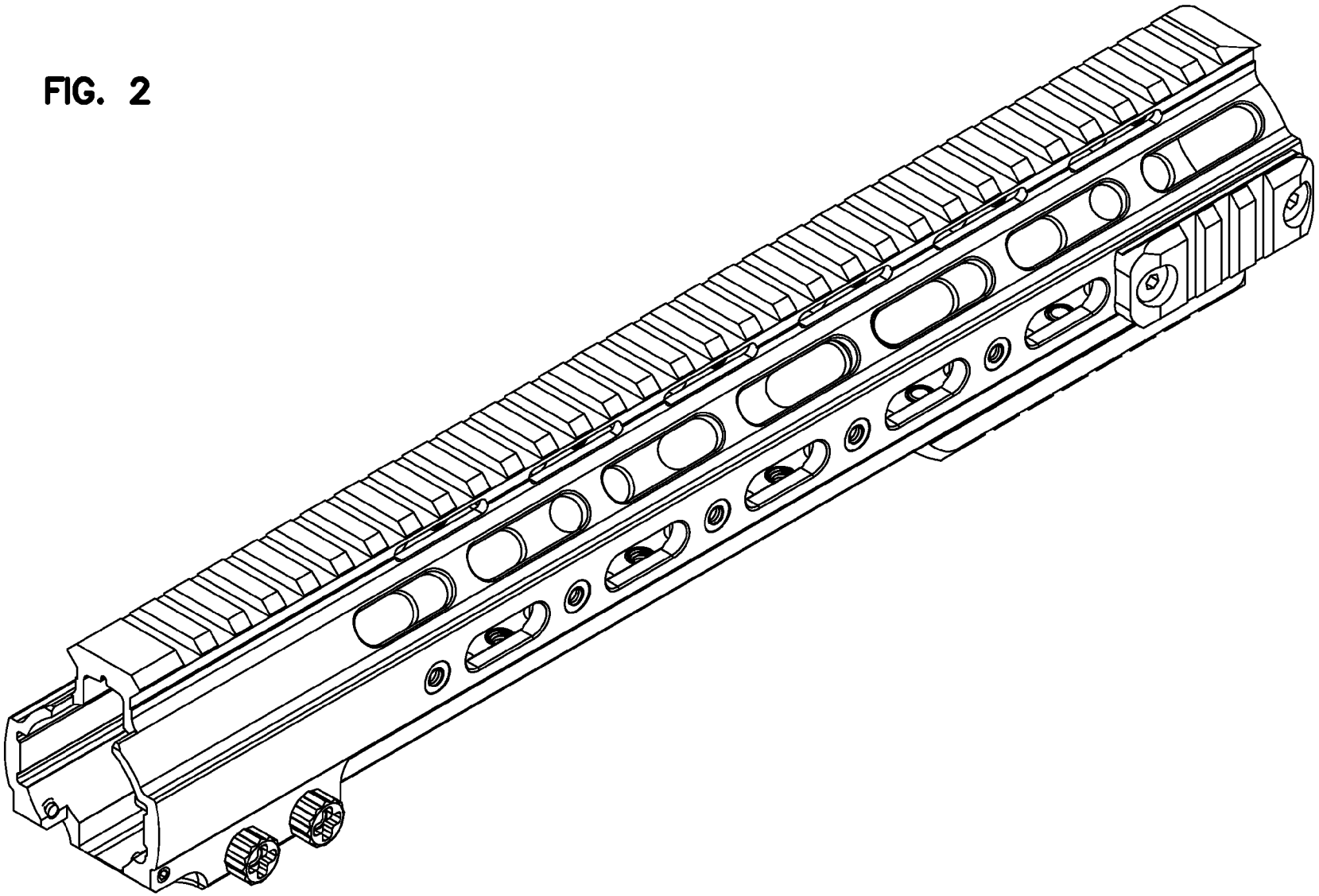
FIG. 2 is a rear left isometric view of the handguard of FIG. 1.
Figure 4:
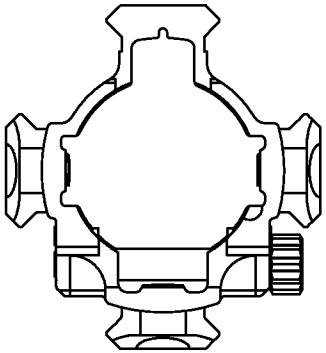
FIG. 4 is a rear elevation view of the handguard of FIG. 1.
Figure 5:
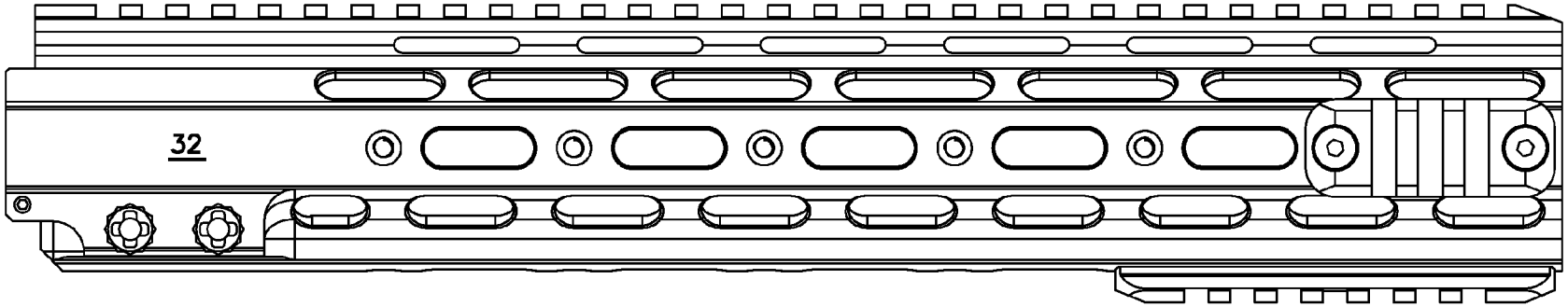
FIG. 5 is a left side elevation view of the handguard of FIG. 1.
Figure 6:
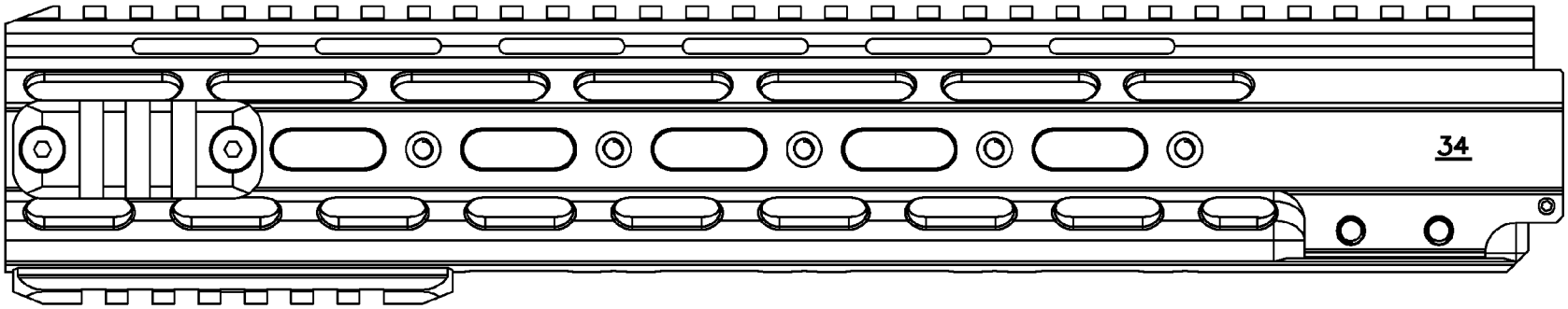
FIG. 6 is a right side elevation view of the handguard of FIG. 1.
Figure 7:
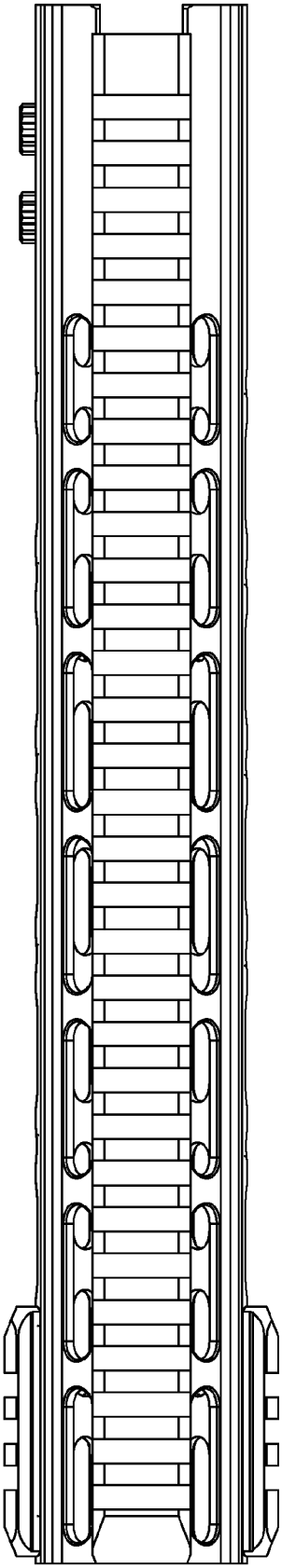
FIG. 7 is a top view of the handguard of FIG. 1.
Figure 8:
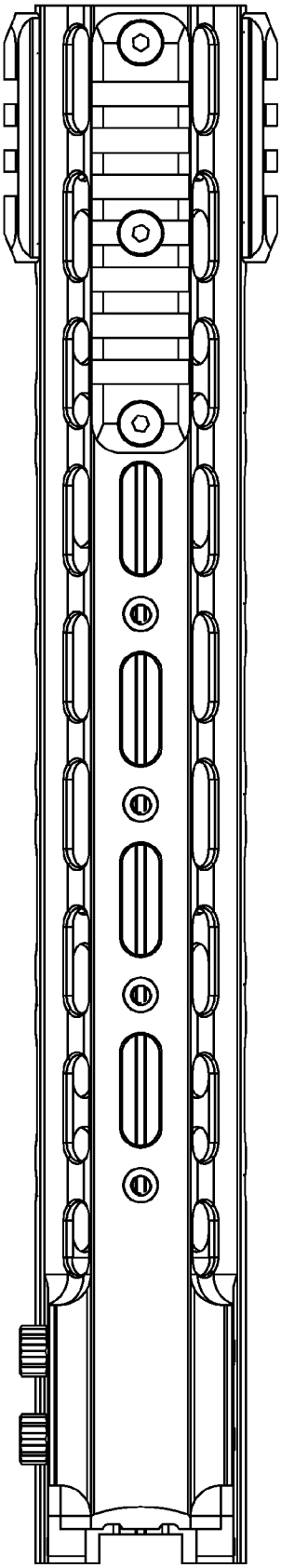
FIG. 8 is a bottom view of the handguard of FIG. 1.

Referring to FIGS. 4-5 and 9, in the depicted embodiment the handguard 10 includes a generally cylindrical body 90 having side wails 32, 34 and a bottom wall 36. The walls are orientated at ninety degrees intervals around the barrel (0° (top rail), 90° (side wail 32), 180° (bottom wall 36), and 270° (side wall 34)). The side walls 32, 34 and bottom wall 36 provide surfaces that the user can ergonomically grip.

Figure 3:
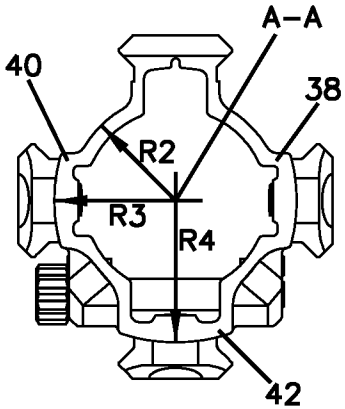
FIG. 3 is a front elevation view of the handguard of FIG. 1.

Referring to FIGS. 3-4, in the depicted embodiment the side walls include raised longitudinal sections 38, 40 that have a radius of curvature R3 of 1.25 inches, and the bottom wall includes a raised longitudinal section 42 with a radius of curvature R4 of between 1.0 inches to 1.5 inches (e.g., 1.25 inches). In the depicted embodiment, the portion of the handguard between the raised sections 38, 40, 42 has a circular cross-section with an outer radius R2 of 0.5 to 1.0 inches (e.g., 0.78 inches). In the depicted embodiment, the raised central longitudinal sections are within 1.25 inches (e.g., 0.98 inches) from the center axis A-A of the handguard. As is evident from the above dimensions, raised central longitudinal sections can have a radius of curvature that is greater than the distance these components are located from center axis of the handguard. The handguard of the depicted embodiment is configured to comfortably sit in the user's hand. The orientation, profile, and location of the raised central portion together provide an ergonomic handguard configuration. It should be appreciated that many alternative configurations are also possible. For example, the dimensions R3 and R4 could be the same. In such a configuration, the surfaces of raised sections 38 and 40 could be either offset or in the same cross sectional circle as the surface of raised section 42. Also, the raised section can be offset from but have the same radius of curvature of R2 (e.g., R2=R3=R4).

Referring to FIG. 9, in the depicted embodiment, the raised central longitudinal sections 38, 40, 42 are configured to support modular rail sections 44, 46 that in turn support rail based weapon accessories. In the depicted embodiment, the modular rail sections 44, 46 include shear lugs 48 and apertures 50 that receive screws 52. To connect the modular rail sections 44, 46 to the handguard, the shear lugs are aligned with one or more apertures 54 in the raised central longitudinal sections 38, 40 of the handguard, which also aligns the apertures 50 with threaded inserts 56 on the handguard. In the depicted embodiment, a pair of shear lugs is configured to be received in a single aperture 54. The screws 52 are tightened, thereby connecting the modular rail section 44, 46 to the handguard. The modular rail sections can be removed or moved via the reverse process. In the depicted embodiment, the shear lugs 48 function to transmit applied loads on the modular rail section to the handguard and prevent failure of the screws 52 due to shear loading. In addition, the shear lugs 48 serve to help the user quickly align the aperture in the modular rail sections 44, 46 with the threaded inserts. It should be appreciated that many alternative configurations are also possible.

In the depicted embodiment, the inside surface of the modular rail sections 44, 46 include a surface profile that matches the surface profile of the outside surface of the raised central longitudinal sections which are configured to be mounted. For example, in the depicted embodiment the modular rail sections have an inside facing surface that has a radius of curvature of 1.25 inches.

Referring to FIGS. 10-18, an alternative embodiment of the handguard is provided. In the depicted embodiment, the handguard 60 has similarities with handguard 10. Both handguards have a unitary construction and both are of the free floating variety. Both handguards attach to the rifle in the same way via the barrel nut 16.

Figure 18:
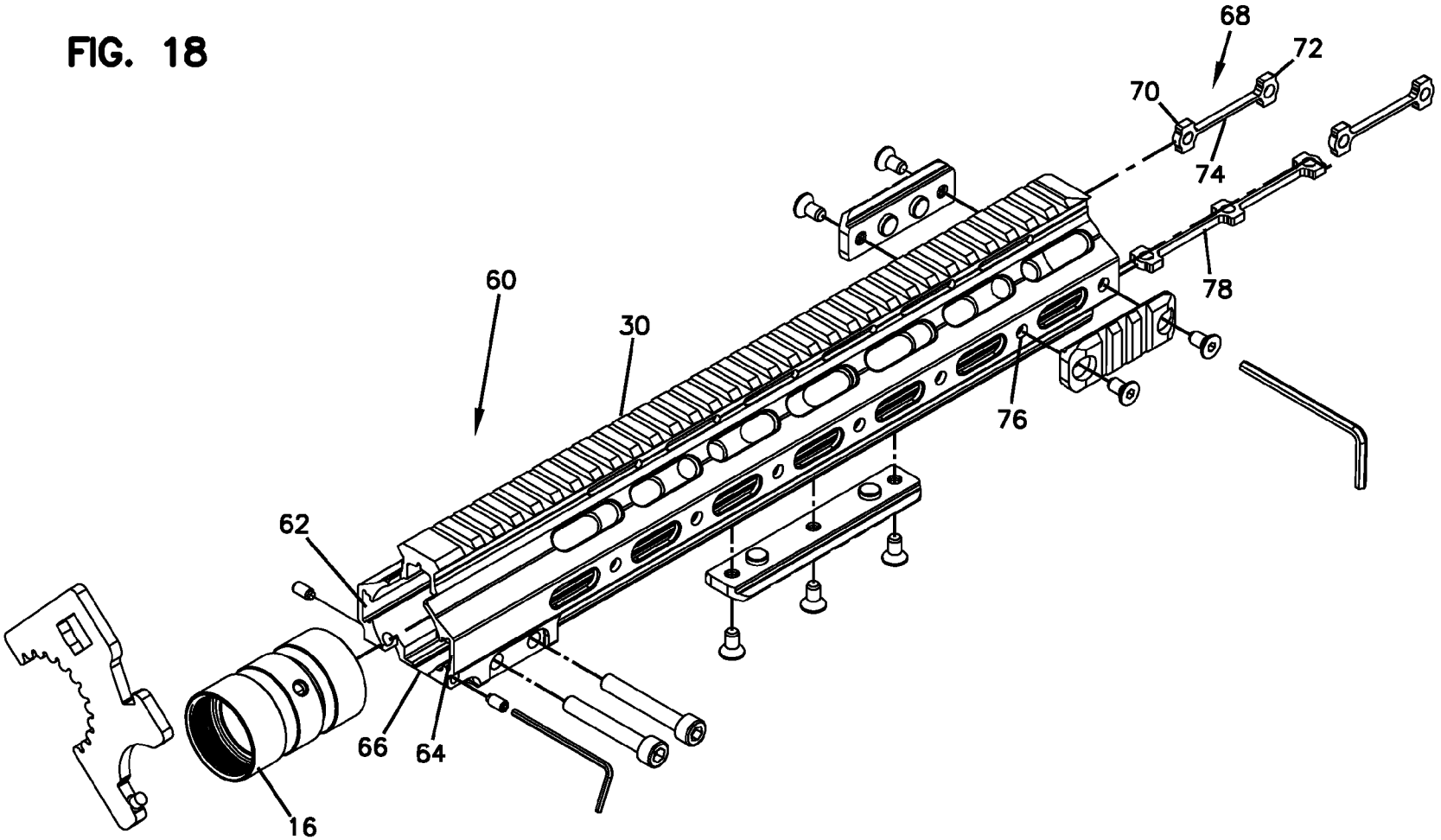
FIG. 18 is an assembly view of the handguard of FIG. 10.
Figure 19:
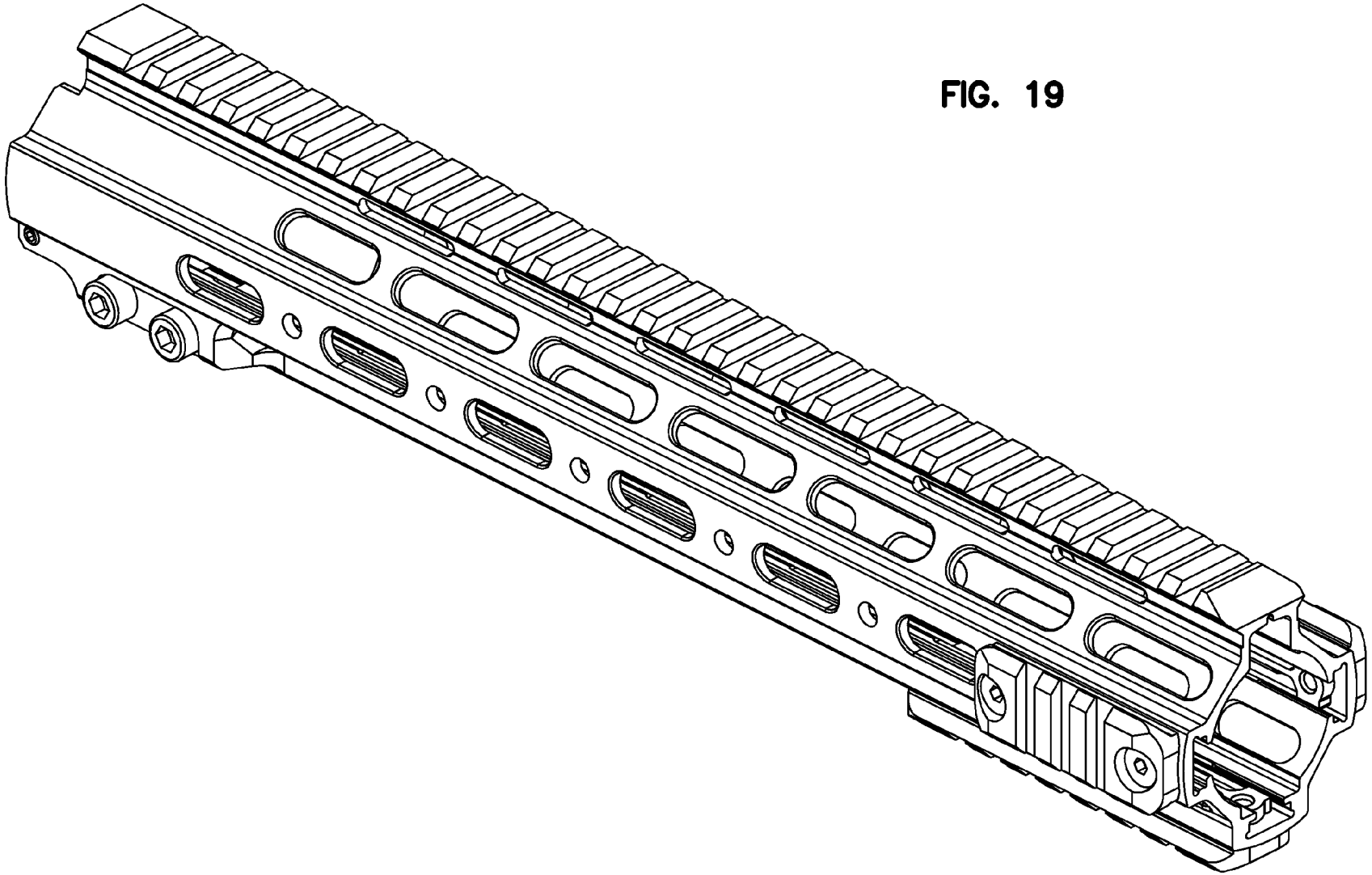
FIG. 19 is a front right isometric view of the handguard according to a third embodiment of the present disclosure.
Figure 20:
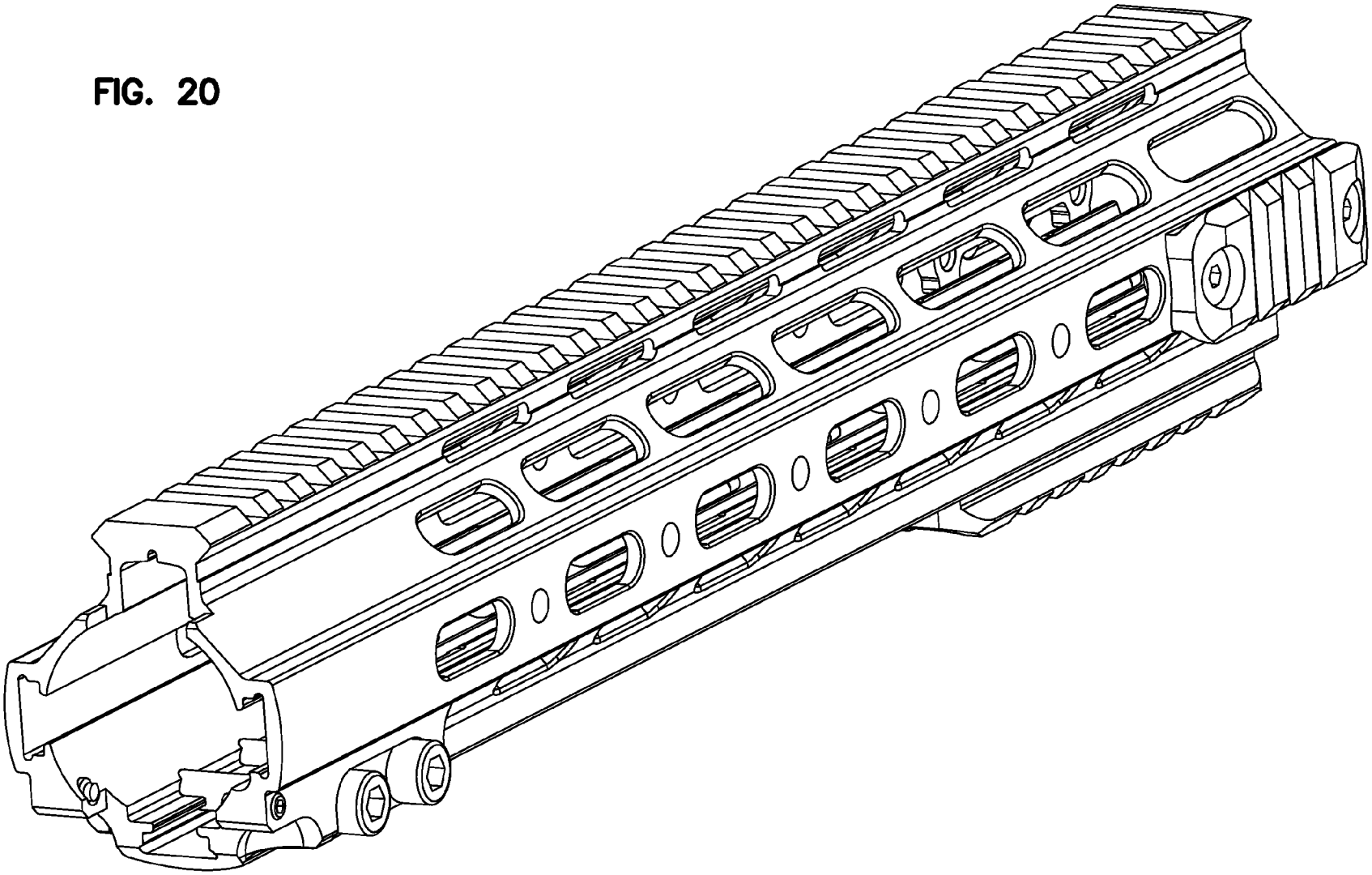
FIG. 20 is a rear left isometric view of the handguard of FIG. 19.
Figure 22:
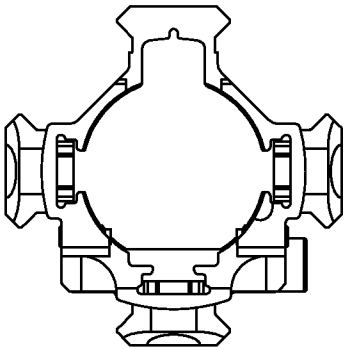
FIG. 22 is a rear elevation view of the handguard of FIG. 19.
Figure 21:
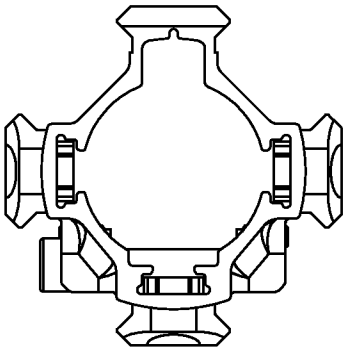
FIG. 21 is a front elevation view of the handguard of FIG. 19.
Figure 23:
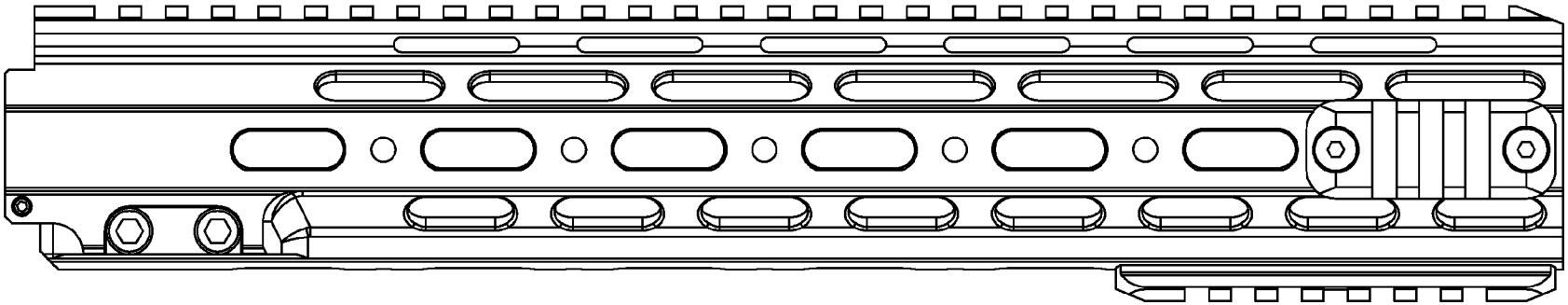
FIG. 23 is a left side elevation view of the handguard of FIG. 19.
Figure 24:
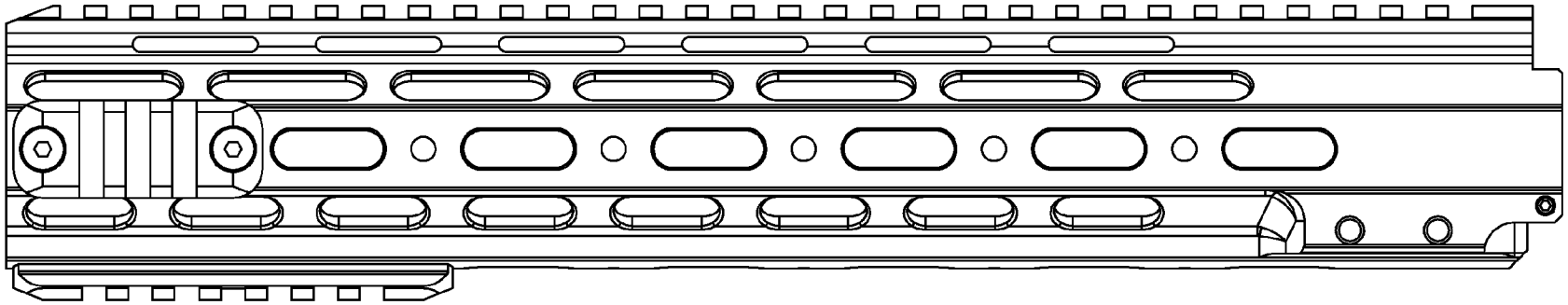
FIG. 24 is a right side elevation view of the handguard of FIG. 19.
Figure 25:
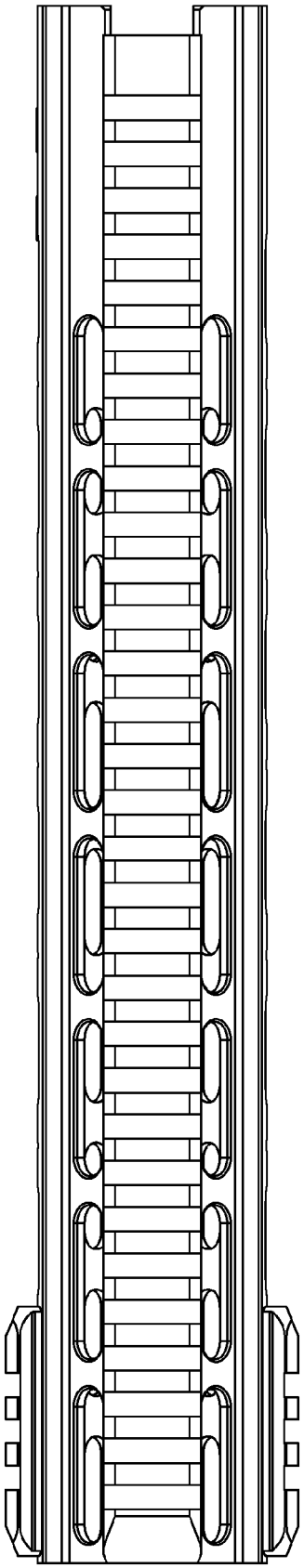
FIG. 25 is a top view of the handguard of FIG. 19.
Figure 26:
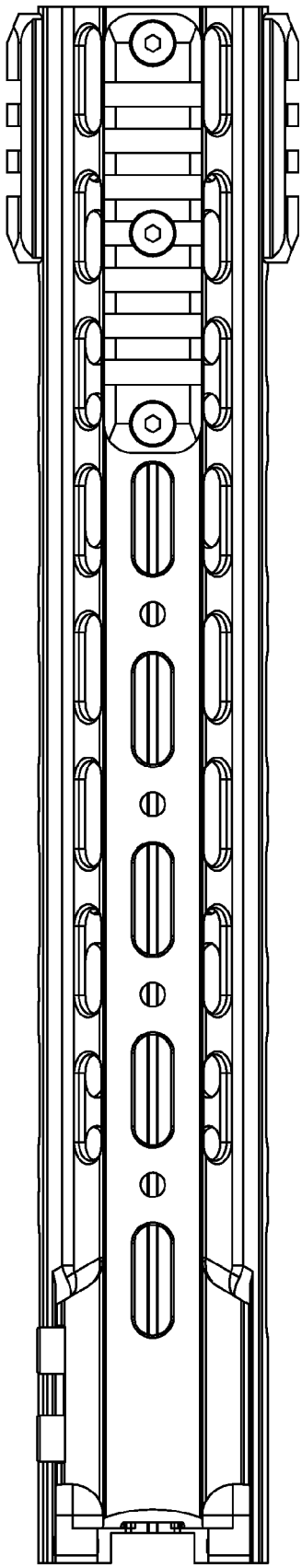
FIG. 26 is a bottom view of the handguard of FIG. 19.
Figure 27:
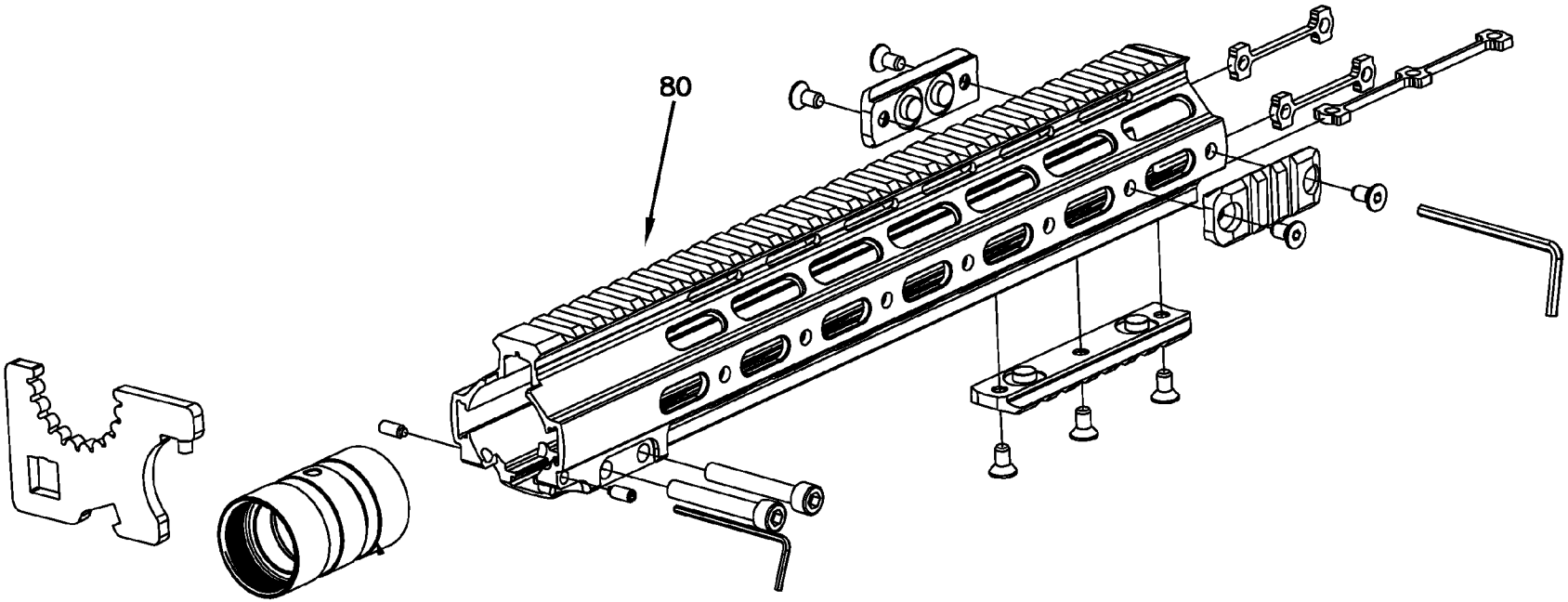
FIG. 27 is assembly view of the handguard of FIG. 19.

Referring to FIG. 18, one difference between the two embodiments is that the handguard 60 does not include threaded inserts 56. Instead, the handguard 60 includes channels 62, 64, 66 along the barrel facing side (inside) of the handguard that are configured to slidably receive slide nuts 68. The slides nuts 68 include a first tab 70 having a threaded aperture connected to a second tab 72 having a second threaded aperture by an arm member 74. To connect the modular rail section to the handguard, the side nuts 68 are slid into the channels 62, 64, 66 until the threaded apertures of the slide nuts 68 are aligned with apertures 76 in the handguard. It should be appreciated that many alternative configurations are also possible.

Once aligned, screws are inserted through the modular rail section, through the apertures 76 and into the threaded aperture of the slide nuts 68. The channels 62, 64, 66 include slide nut retaining arms 90, 92 that limit radial movement of the slide nuts 68 relative to the barrel and allowed for axial movement relative to the barrel (see FIG. 12). The channels are configured to prevent the slide nuts from falling towards the barrel and from rotating. This configuration makes assembly easier as the side nuts do not have to be manually held against the handguard during assembly. Also, the arm member 74 is configured to further facilitate assembly since aligning one of the threaded apertures of the tab with aperture 76 automatically aligns the other handguard aperture with the threaded apertures of the slide nut (see FIG. 18). Slide nuts 68 can also be configured to include three threaded apertures which are automatically aligned with aperture 76 of the handguard once a single threaded aperture is brought into alignment. The arm members 74, 78 of the slide nut 68 in the depicted embodiment are tapered down for weight savings. To disconnect the modular rails section from the handguard 60, the user only needs to unthread the screws and allow the slide nut to drop out of the channel. It should be appreciated that many alternative configurations are also possible.

Another difference between handguard 10 and 60 is in the profile of the raised central longitudinal sections. As described above, the profile of these sections in handguard 10 is curved. In the handguard 60, the profile of these sections is flatter with radius edges/corners.

Referring to FIGS. 19-27, another embodiment of a handguard according to the present disclosure is shown. In the depicted embodiment, the handguard 80 combines features from handguard 10 and handguard 60. In particular, the handguard 80 is similar to the handguard 60 in that it includes channels that receive slide nuts for mounting modular rail sections thereto. The handguard 80 is similar to the handguard 10 in that the raised central longitudinal sections have curved profiles like the ones described above with reference to handguard 10.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A free-floating handguard for a rifle comprising:

a generally cylindrical body including a first end portion and an opposed second end portion;

an integral top firearm accessory mounting rail located along the top portion of the body;

a left longitudinal section extending from the left of the cylindrical body configured to support a removable firearm accessory mounting rail section;

a right longitudinal section extending from the right of the cylindrical body configured to support a removable firearm accessory mounting rail section; and a bottom longitudinal section extending from the bottom of the cylindrical body;

wherein at least one of the left and right longitudinal sections have a curved cross-sectional profile having a radius of curvature that is greater than the outside radius of the cylindrical body;

wherein the body includes threaded inserts configured to secure modular firearm accessory mounting rail sections;

wherein each of the left or right longitudinal sections includes apertures for receiving shear lugs of the removable firearm accessory mounting rail sections; and wherein between the apertures for receiving shear lugs are apertures that receive screws that connect the removable firearm accessory mounting rail sections to the longitudinal sections and wherein each aperture for receiving shear lugs is configured to receive a pair of shear lugs.

2. The hand guard of claim 1, wherein the radius of curvature of the left and right longitudinal sections is between 1.0 to 1.5 inches and the radius of the cylindrical body is between 0.5 and 1.0 inches and wherein the left and right longitudinal sections have substantially the same radius of curvature.

3. The hand guard of claim 1, wherein the body portion includes a single piece unitary construction.

4. The handguard of claim 1, further comprising longitudinal channels located on the inside portion of the cylindrical body opposite at least one of the longitudinal sections, wherein the channels are configured to receive slide nuts.

5. The handguard of claim 4, wherein the slide nuts include at least spaced apart threaded apertures and wherein the spacing between the threaded apertures corresponds to spacing between at least one pair of apertures in the longitudinal section.

6. The handguard of claim 4, wherein the channels are configured to retain the slide nuts in the radial direction and allow the slide nuts to slide axially.

7. The hand guard of claim 1, further comprising removable firearm accessory mounting rail sections secured to at least one of the left or right longitudinal sections.

* * * * *